US006457390B1

(12) United States Patent
Daubinger et al.

(10) Patent No.: US 6,457,390 B1
(45) Date of Patent: Oct. 1, 2002

(54) SCREW FEEDING DEVICE FOR A POWER SCREW DRIVING TOOL

(75) Inventors: Gerd Daubinger, Munich (DE); Andreas Pally, Baar (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/973,410

(22) Filed: Oct. 9, 2001

(30) Foreign Application Priority Data

Oct. 10, 2000 (DE) ..... 100 50 281

(51) Int. Cl.[7] ..... B25B 23/04
(52) U.S. Cl. ..... 81/434; 81/57.37
(58) Field of Search ..... 81/434, 433, 435, 81/57.37, 54

(56) References Cited

U.S. PATENT DOCUMENTS 4,018,254 A * 4/1977 DeCaro ..... 81/57.37
6,227,429 B1 * 5/2001 Hunag ..... 81/57.37

* cited by examiner

*Primary Examiner*—James G. Smith
*Assistant Examiner*—Hadi Shakeri
(74) *Attorney, Agent, or Firm*—Sidley Austin Brown & Wood, LLP

(57) ABSTRACT

A screw feeding device for a power screw driving tool and including a housing (1) connectable with the power screw driving tool, a guide (2) having a carrier (4) projecting transverse to a setting direction of the screws (18) for supporting a screw magazine (17), a support (6) stepwise displaceable relative to the guide (2) parallel to the setting direction, and an elastic adjusting element (10) for connecting the support (6) with the guide (2) and having a prestressed disengaged position in which the support can be displaced relative to the guide.

10 Claims, 4 Drawing Sheets

SCREW FEEDING DEVICE FOR A POWER SCREW DRIVING TOOL

BACKGROUND OF THE INVENTION

1. Field of the Invention

The present invention relates to a screw feeding device for a power screw driving tool for driving in screws which are arranged in a strip-shaped screw magazine, with the device including a housing connectable with the power screw driving tool, a guide having a carrier projecting transverse to a setting direction of the screws for supporting the screw magazine, a support stepwise displaceable relative to the guide parallel to the setting direction and a bearing surface projecting, in the setting direction, beyond the guide, and an adjusting element for connecting the support with the guide.

2. Description of the Prior Art

German Publication DE-19522815.4 discloses a screw feeding device for a power screw driving tool for driving-in screws stored in strip-shaped screw magazine. The screw feeding device includes a housing, a guide, a support, an adjusting element, and a guide channel extending transverse to the setting direction of the screws. The housing can be connected with the power screw driving tool, and all of the components of the device listed above are displaceable relative to the tool in a direction opposite the setting direction against a biasing force. A carrier with a transporting channel for receiving and guiding the strip-shaped screw magazine projects from the guide in a direction transverse to the setting direction. The guide is surrounded by a support having a recess and a bearing surface that projects beyond the setting direction side of the guide. The guide is provided with three threaded bore extending in the setting direction in a spaced relationship to each other. In order to insure handling of screws having different length, the support can be stepwise displaced relative to the guide in a direction parallel to the setting direction. The support is secured to the guide with a screw that extends through the recess formed in the support and into one of the threaded bores of the guide.

The guide channel is limited, in the direction opposite to the setting direction by a setting direction end side of the guide. In the setting direction, the guide channel is limited by a counter surface of an intermediate member arranged in the support. The intermediate member can be secured, with a further screw, along the support in three different positions. The further screw extends into one of three side through-bores formed in the support and projects in a further threaded bore in the support.

In addition to the recess for receiving the screw attaching the support to the guide and to the through-bores for receiving the intermediate member-attaching screw, the support has side through-openings spaced from each other and the inner width of which is larger than the cross-section of the strip of the screw magazine on which separate, releasable screws are arranged.

The diameter of the recess formed in the support and the diameter of the screw, which secures the support to the guide, are so matched with each other that a small displacement of the support with respect to the guide is still possible when the securing or connecting screw is screwed in one of the threaded bores of the guide. This clearance is necessary for an axial retaining of the screw magazine strip on the screw feeding device during pressing of the power tool against a constructional component.

The formation of the circular recesses, the through-bores, and the through-opening in the support is connected with large expenses. In addition, an axial adjustment of the support with respect to the guide for accommodating different screw magazines having screws having a different length, can be effected only with the use of additional or separate working tools for screwing and unscrewing respective screws.

Accordingly, the object of the present invention is to provide a simple and economically manufacturable screw feeding device with a support that can be displaced relative to the guide between different displacement positions without using any additional working tool.

SUMMARY OF THE INVENTION

This and other objects of the present invention, which will become apparent hereinafter, are achieved by providing a support with a plurality of recesses arranged one after another in the setting direction, and an elastic support which cooperates, in its unstressed initial position, with at least one recess of the support and which enables, in its free prestressed disengagement position, a displacement of the support relative to the guide and to the adjusting element.

The adjusting element according to the present invention can be quickly and simply brought, by the tool user, without the use of any tools, in its prestressed disengaged position in which the support can be displaced relative to the guide. After the displacement of the support, the adjustment element is brought back into its position, in which it formlockingly cooperates with the support, by the prestressing force. The adjusting element can be economically produced of a plastic material by injection molding.

Advantageously, the adjusting element has at least one elastic arm pivotable in a plane extending transverse to the setting direction and transverse to the longitudinal extent of the guide channel and having a locking tongue formlockingly engageable with at least one stop of the guide for connecting the elastic adjusting element with the guide. The formlocking connection of the adjusting element with the guide facilitates mounting all of the components of the screw feeding device. E.g., both the adjusting element and the guide can be connected, in one operational step, with the housing of the screw feeding device and the connection sleeve of the power screw driving tool.

In order to achieve a good centering of the working tool with rotation receiving means provided in heads of screws, the strip of the strip-shaped screw magazine should be secured, during the driving-in process, with respect to the guide. This securing, e.g., can be achieved by clamping the strip in the guide channel. This, advantageously, is achieved by provided for a limited displacement of the adjusting element relative to the guide in a direction parallel to the setting direction. This limited displacement permits to change the height, which is measured in a direction parallel to the setting direction, of the guide channel that is formed by the adjusting element and the guide.

Advantageously, an elastic arm of the adjusting element has a connection web that engages the at least one recess in the support for axially securing the support on the guide. The connection web is proved in an end region of the elastic arm facing in a direction opposite the setting direction and connects a grip element with the elastic arm. The height of the connection web, which is measured in a direction parallel to the setting direction, corresponds to the inner length of the separate recesses measured in the same direction. The length of the connection web, which is measured in the direction parallel to the longitudinal extent of the guide channel, corresponds substantially to the width of the recesses measured in the same direction. Because the connection web forms part of an elastic arm, it can be easily displaced, without any tool and with a small force, out of a recess into a prestressed disengaged position in which the arm has been pivoted.

A particularly good formlocking connection of the adjusting element with the support is advantageously achieved when the adjusting element has two elastic arms projecting from a bottom of the adjusting element in the direction opposite the setting direction and pivotable toward each other in the same plane. Both elastic arms of the adjusting element and the recesses in the support are provided on a side remote from the magazine carrier that projects sidewise from the guide. The two arms can be easily brought in their disengaged position in which the connection webs do not project into the recesses of the support.

In order to prevent tilting of the adjusting element relative to the support when the support is displaced relative to the adjusting element, the adjusting element has two opposite, extending in a direction parallel to the setting direction, guide strips engaging in two opposite, likewise extending in a direction parallel to the setting direction, guide grooves formed in the support. Both guide strips are provided in the region of the bottom of the adjusting element so that they can still extend in the guide grooves when the two elastic arms are pivoted in their prestressed disengaged position.

In order to provide for an exactly parallel to the setting direction, guidance of the support relative to the power tool housing, the support has advantageously, on its outer side, two opposite, extending in the direction parallel to the setting direction, first guide regions that formlockingly cooperate with adjacent to each other guide edges provided on an inner side of the housing.

For a precise, parallel to the setting direction, guidance of the support relative to the guide, the support has on its inner side, two adjacent to each other, extending in a direction parallel to the setting direction, second guide regions which cooperate with extending in the direction parallel to the setting direction, guide surfaces provided on an outer side of the guide.

Preferably, each of the adjusting element and the guide has a guide web projecting into the guide channel. Both guide webs extend parallel to the longitudinal extent of the guide channel and lie in a plane that extends parallel to the setting direction. The two guide webs form side supports for the screw magazine strip in the guide channel.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 3:
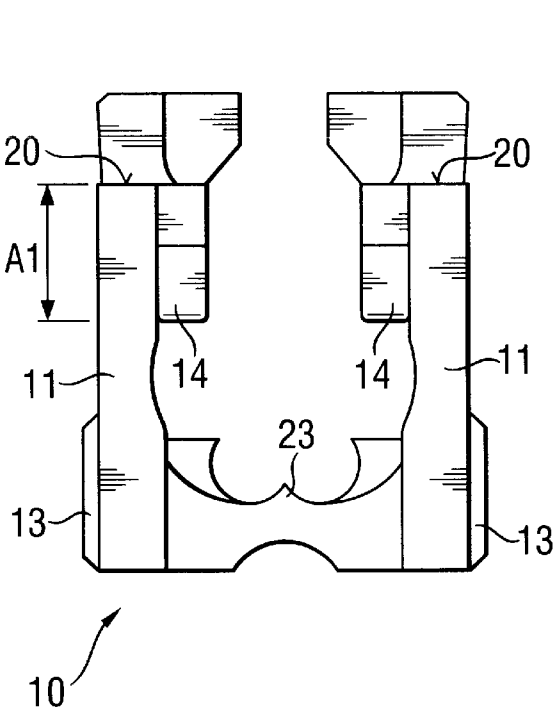
FIG. 3 a rear view of the adjusting element shown in FIG. 1.
Figure 2:
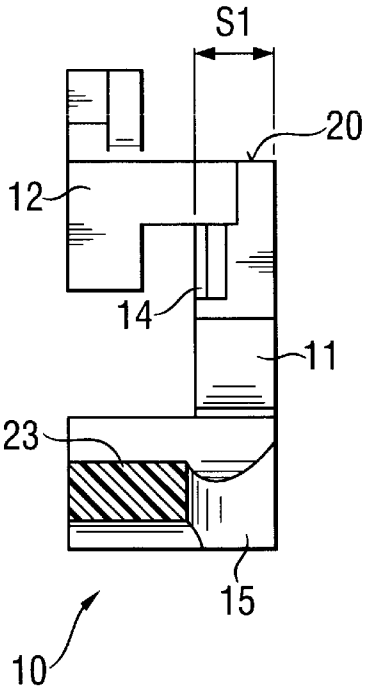
FIG. 2 a transverse cross-sectional view of the adjustment element shown in FIG. 1 along line II—II.
Figure 1:
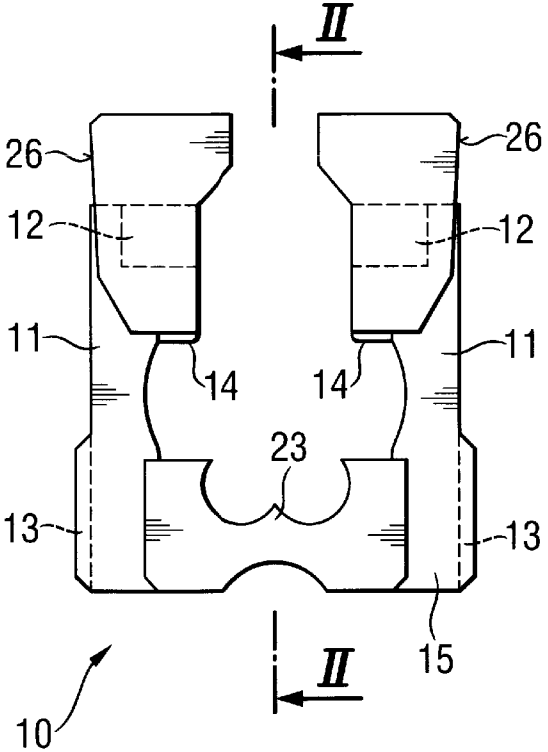
FIG. 1 a front view of an adjustment element of a screw feeding device according to the present invention.
Figure 5:
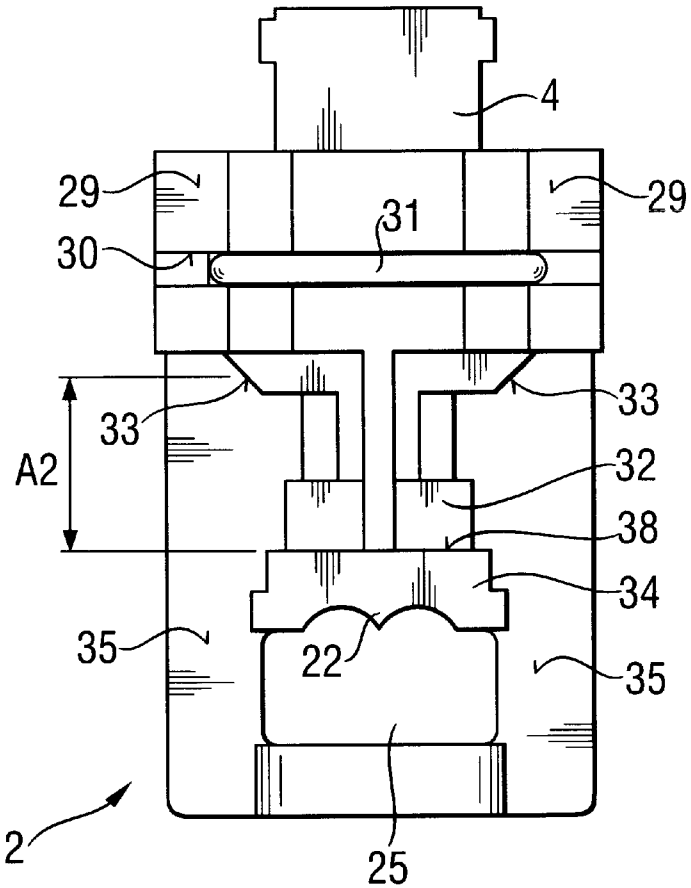
FIG. 5 a front view of the guide shown in FIG. 4.
Figure 4:
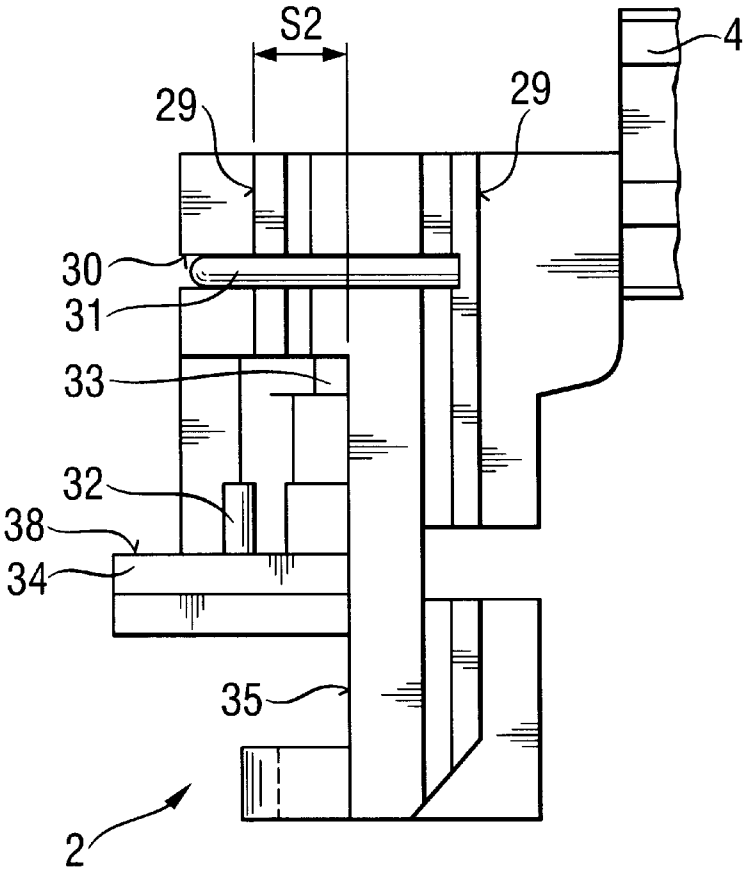
FIG. 4 a side view of a guide of screw feeding device according to the present invention.
Figure 7:
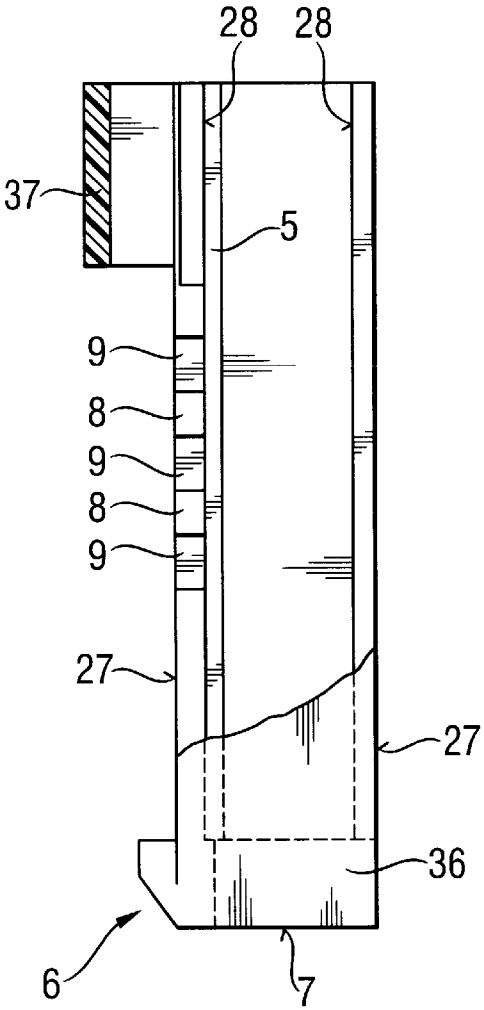
FIG. 7 a side, partially cross-sectional view of the support shown in FIG. 6.
Figure 6:
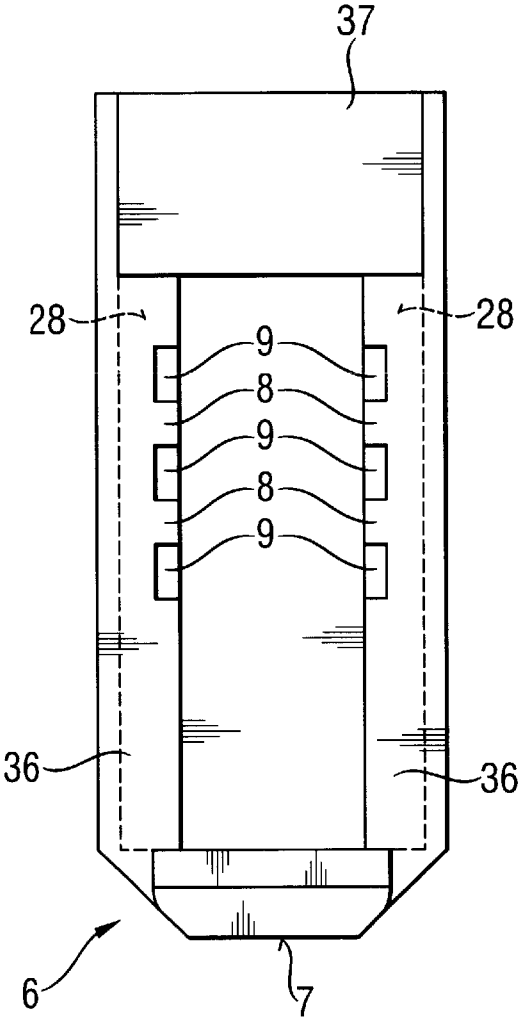
FIG. 6 a front view of a support of a screw feeding device according to the present invention.

FIG. 1 through 9 show a screw feeding device according to the present invention for use with a power screw driving tool for setting screws 18 stored in a strip-shaped screw magazine 17.

The screw feeding device includes a housing 1, a guide 2, a support 6, an elastic adjusting element 10, and a guide channel 25 extending transverse to a setting direction of the screws 18. The housing 1 is formlockingly connectable with a setting direction side, end region of the power screw driving tool. The guide 2 formlockingly cooperates with a connection sleeve 19 of the screw driving tool. The setting direction side, end region of the connection sleeve 19 extends into a receiving bore (not shown) of the guide 2. A radially elastic Locking ring 30 which is received, e.g., in a circumferential groove (not shown) formed on the connection sleeve 19, insures the connection of the connection sleeve 19 with the guide 2. The locking ring 30 is carried in a groove 31 formed in the guide 2. The guide 2, the support 6, and the adjusting element 10 are displaceable, with respect to the power screw driving tool, parallel to the setting direction against biasing forces of a spring F (see FIG. 8). The spring means can be arranged either in the central bore of the connection sleeve 19 or on its outer surface. Also located in the central bore of the connection sleeve 19, a rotatable screw-in working tool connected with the power tool. The screw-in tool is axially displaceable in the bore of the connection sleeve 19.

An adjusting element 10, which is shown in FIGS. 1–3, 8 and 9, has a bottom 15 from which two, spaced from each other, arms 11 project. The arms 11 are elastic. A side of the bottom 15, which faces in a direction opposite the setting direction, has a depression which forms part of a guide channel 25 that is formed by the adjusting element 10 and the guide 2. A guide web 23 projects into the depression, forming a side support for a strip 16 of the screw magazine 17. In the region of the bottom 15, the adjusting element 10 is provided with two guide strips 13 arranged, respectively, on two, spaced from each other, side surfaces. The two elastic arms 11 pivot toward each other in a plane that extends parallel to the setting direction and transverse to a longitudinal extent of the guide channel 25. At their end regions opposite the bottom 15, the elastic arms 11 are connected, respectively, with grip members formed integrally with respective arms 11. Each grip member has a grip surface 26, with the grip surfaces 26 of the two grip members facing in opposite directions.

Two locking tongues 14 are provided, respectively, in the outer regions of the two connecting webs 12. The locking tongues 14 formlockingly connect the adjusting element 10 with two stops 32 of the guide 2. A length of the two elastic arms 11, in a direction parallel to the longitudinal extent of the guide channel 25, is designated with a reference sign S1. At its free end opposite the bottom 15, the adjusting element 10 has a stop edge 20 facing in the direction opposite the setting direction. The distance between the stop edge 20 and a free, facing in the setting direction, end of a locking tongue 14 is designated with a reference sign A1.

A guide 2, which is shown in FIGS. 4, 5, 8 and 9, carries a carrier 4 that projects transverse to the setting direction. The carrier 4, which is shown only partially, has a transporting channel for receiving and guiding the strip-shaped screw magazine 17. The guide 2 has two, spaced from each other, inclination surfaces 33 which prevent a radial engagement of the two elastic arms 11 of the adjusting element 10 during driving of a screw 19, during a setting process, in a constructional component (not shown). The guide 2 has two, spaced from each other, stops 32 which are engaged from behind by the locking tongues 14 of the adjusting element 10. The largest portion of the guide channel 25 is formed by a through-bore formed in the guide 2. The guide 2 has a stop nose 34 the side of which, facing in the setting direction, has a guide web 22 which, as the guide web 23 of the adjusting element 10, provides for a sidewise guidance, at least during the screw-in process, of the strip of the strip-shaped magazine 17. On its outer side, the guide 2 is provided with four guide surfaces 29 that serve for aligning and guiding the guide 2 in the support 6. The guide 2 further has two support or bearing surfaces 35 against which the adjusting element 10 is supported during the setting condition. The bearing surfaces 35 lie in a plane that extends parallel to the setting direction and transverse to the longitudinal extent of the guide channel 25. The distance S2, which is measured parallel to the longitudinal extent of the guide channel 25 corresponds to the length S1 of the elastic arms 11 of the adjusting element 10, which is likewise measured in a direction parallel to the longitudinal extent of the guide channel 25.

The support 6, which is shown in FIGS. 6–9, is formed essentially of two, spaced from each other, strip-shaped wall elements 36. The wall elements 36 extend in two planes that extend parallel to the setting direction and parallel to the longitudinal extent of the guide channel 25. Both wall elements 36 are connected with each other at two end regions of the support 6. In the setting direction end region of the support 6, its bottom serves for connecting the two wall elements. At the opposite end of the support 6, a connection stirrup 37 connects the two wall elements 36. The two wall elements 36 have, on their side adjacent to each other, each two guide regions 28 that, in an assembled condition of the screw feeding device, cooperate with guide regions 29 of the guide 2. Parallel to the guide regions 28, along each of the wall section 36, a guide groove 5 extends. The guide grooves 5 serve for receiving and guiding the guide strips 13 of the adjusting element 10. At their ends remote from the support 4, the wall elements 36 have each three recesses 9 with two projections 8 lying in a plane extending transverse to the setting direction. The three planes, each with two recesses 9, are separated, in the setting direction, by projections 8 of the support 6. Between the projection 8 closest to the bottom, and the bottom, the wall elements 36 have, in a direction transverse to the setting direction, an empty space the width of which is at least equal to a width of a space between two opposite recesses 9.

In which of the recesses 9 of the support 6, the connection webs 12 of the two arms 11 of the adjusting element 10 project depends on a length of a to be driven screw 18. When screws 18, which have a large length, are driven in, it is important that a setting direction side, bearing surface 7 of the support 6 is spaced from the guide 2 by a sufficiently large distance. The largest spacing between the bearing surface 7 and the guide 2 is obtained when the connection webs 12 project in those two recesses 9 which are spaced from the bearing surface 7 of the support 6 by a largest distance.

For driving in screws 18 having a short length, the two elastic arms 11 of the adjusting element 10 are pressed toward each other so that the connection webs 12 do not project any more into the recesses 9. In this position of the adjusting member 10, the support 6 can be displaced relative to the guide 2 until a desired distance between the bearing surface 7 of the support 6 and the guide 2 is reached. Upon release, the two pre-loaded elastic arms 11 return into their initial position, with the two connection webs 12 again projecting in a respective pair of the recesses 9 of the support 6 which provides for securing of the support 6 to the guide 2.

Figure 9:
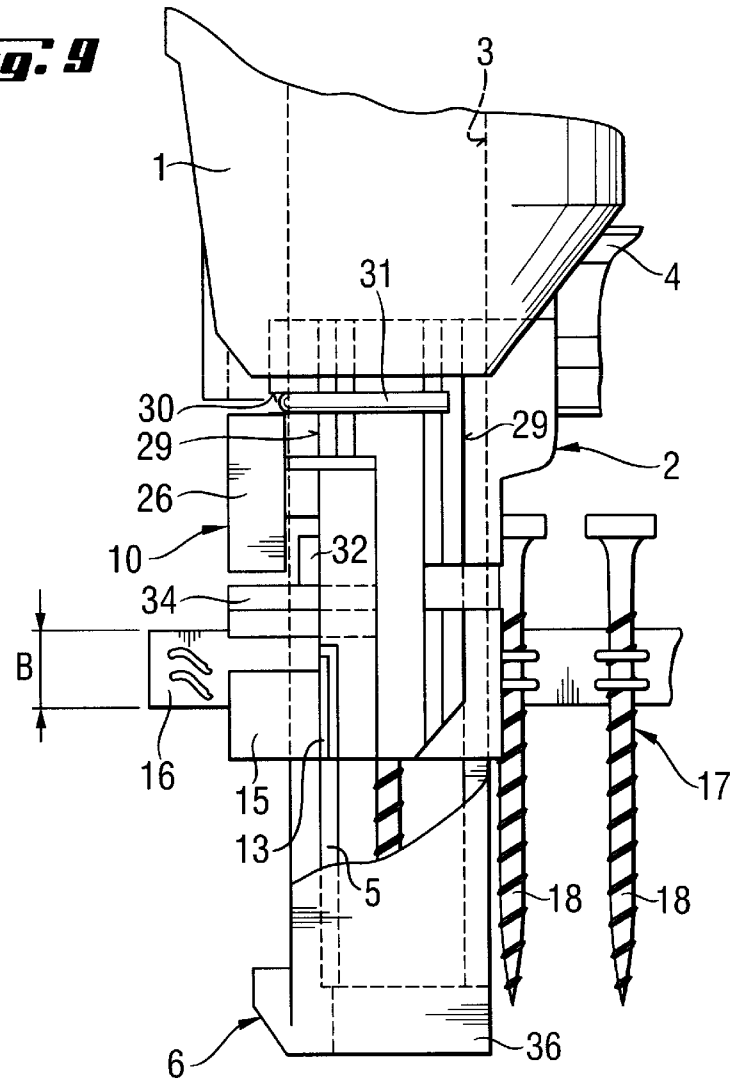
FIG. 9 a side, partially cross-sectional view of the screw feeding device shown in FIG. 8.
Figure 8:
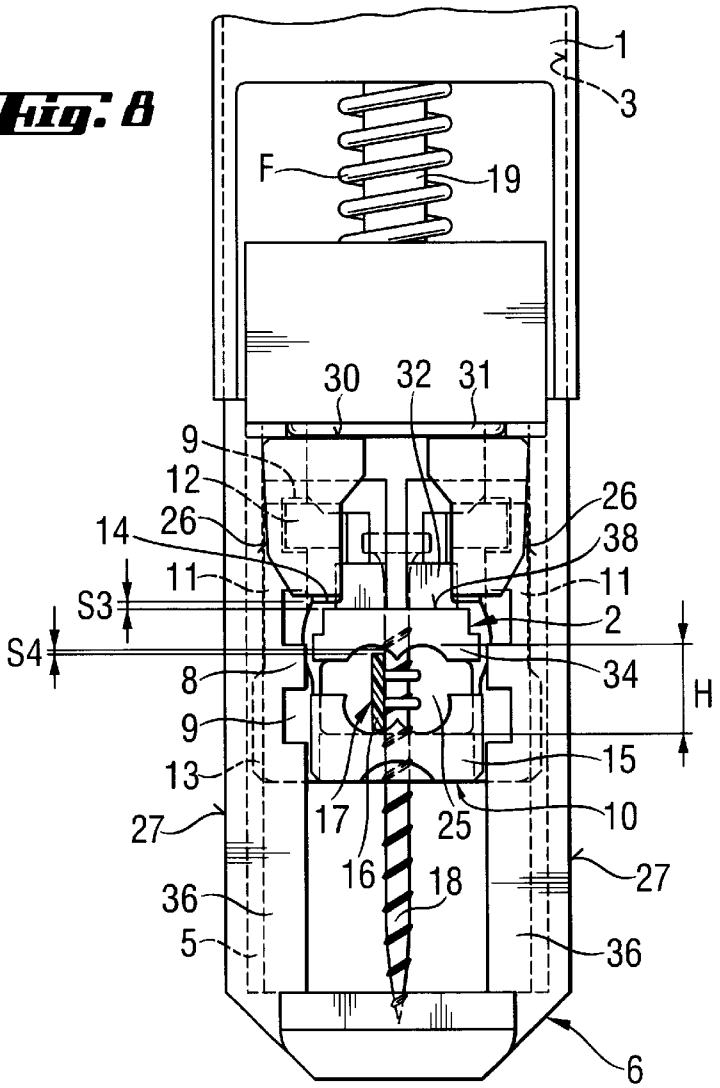
FIG. 8 a front view of a screw feeding device according to the present invention which is connected with a screw magazine.

As shown in FIGS. 8–9, the guide channel 25 is formed by the stop nose 34 of the guide 2 and the bottom 15 of the adjusting element 10. A strip 16 of the strip-shaped screw magazine 17 with a plurality of spaced from each other screws 18 extends through the guide channel 25. The strip 16, has, in a direction parallel to the setting direction, a width B which is smaller than a smallest height H, which is measured in the same direction of the guide channel 25, whereby a maximum clearance S4 is formed, in the setting direction, between the strip 16 and the guide channel 25. In order to be able to secure the strip 16 in the guide channel 25, at least during driving in of a screw 18, the adjusting element 10 can be displaced relative to the guide 2 in the setting direction by a limited amount. The limited displacement results from the fact that the distance A1 between the stop edge 20 and the locking tongue 14 of the adjusting element 10 is smaller than the distance A2 between a facing in the direction opposite the setting direction, support surface 38 of the stop nose 34 and the inclined surfaces 33 of the guide 2. This difference is shown with a reference sign S3. An operative fixing or claming is achieved when the difference 33 between the distances A1 and A2 is larger than a maximum clearance S4 between the strip 16 and the guide channel 25.

The guidance of the support 6 relative to the housing 1 in a direction parallel to the setting direction is achieved by the provision, on the outer side of the support 6, of spaced from each other guide regions 27 which formlockingly cooperate with extending parallel to the setting direction, guide edges 3 provided on the inner side of the housing 1.

Though the present invention was shown and described with references to the preferred embodiment, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiment within the spirit and scope of the present invention as defined by the appended claims.

What is claimed is:

1. A screw feeding device for a power screw driving tool for driving in screws (18) which are arranged in a strip-shaped screw magazine (17), the device comprising a housing (1) connectable with the power screw driving tool; a guide (2) having a carrier (4) projecting transverse to a setting direction of the screws (18) for supporting the screw magazine (17); a support (6) stepwise displaceable relative to the guide (2) parallel to the setting direction, and having a plurality of recesses arranged one behind another in the setting direction, and an elastic adjusting element (10)

connecting the guide (2) with the support (6), the adjusting element (10) cooperating, in an unstressed initial position thereof, with at least one recess (9) of the support (6) for enabling, in a prestressed disengaged position thereof, a displacement of the support (6) relative to the guide (2) and to the adjusting element (10).

2. A screw feeding device according to claim 1, further comprising a guide channel (25) formed by the guide (2) and the adjusting element (10), and means for biasing the guide (2), the support (6), the adjusting element (10), and the guide channel in the setting direction, the guide (2), the support (6), the adjusting element (10), and the guide channel (25) being displaceable relative to the power screw driving tool in a direction opposite the setting direction against a biasing force of the biasing means.

3. A screw feeding device according to claim 2, wherein the adjusting element (10) has at least one elastic arm (11) pivotable in a plane extending transverse to the setting direction and transverse to the longitudinal extent of the guide channel (25) and having a locking tongue (14) form-lockingly engageable with at least one stop (32) of the guide (2) for connecting the elastic adjusting element (10) with the guide (2).

4. A screw feeding device according to claim 3, wherein the adjusting element (10) comprises means for enabling a limited displacement of the adjusting element (10) relative to the guide in a direction parallel to the setting direction for changing a height (H), which is measured parallel to the setting direction of the guide channel (25), which is formed by the adjusting element (10) and the guide (2).

5. A screw feeding device according to claim 3, wherein the at least one elastic arm (11) of the adjusting element (10) has a connection web (12) that engages the at least one recess (9) in support (6) for axially securing the support (6) on the guide (2).

6. A screw feeding device according to claim 3, wherein the adjusting element (10) has two elastic arms (11) projecting from a bottom (15) of the adjusting element (10) in the direction opposite the setting direction and pivotable toward each other in a same plane.

7. A screw feeding device according to claim 1, wherein the adjusting element (10) has two opposite, extending in a direction parallel to the setting direction, guide strips (13) engaging in two opposite, likewise extending in a direction parallel to the setting direction guide grooves (5) formed in the support (6).

8. A screw feeding device according to claim 7, wherein the support (6) has, on an outer side thereof, two opposite, extending in the direction parallel to the setting direction, first guide regions (27) that formlockingly cooperate with adjacent to each other guide edges (3) provided on an inner side of the housing (1).

9. A screw feeding device according to claim 1, wherein the support (6) has, on an inner side thereof, two adjacent to each other, extending in a direction parallel to the setting direction, second guide regions (28) which cooperate with extending in the direction parallel to the setting direction, guide surface (29) provided on an outer side of the guide (2).

10. A screw feeding device according to claim 4, wherein the adjusting element (10) and the guide (2) have each a guide web projecting into the guide channel (25).

* * * * *